US005634647A

United States Patent [19]

Gorza et al.

[11] Patent Number: 5,634,647

[45] Date of Patent: Jun. 3, 1997

[54] BRAKING DEVICE PARTICULARLY FOR SKATES

[75] Inventors: Roberto Gorza, Feltre; Claudio Zorzi, Paderno Di Ponzano Veneto; Renzo Balbinot, Pieve Di Soligo, all of Italy

[73] Assignee: Nordica, S.p.A., Treviso, Italy

[21] Appl. No.: 346,308

[22] Filed: Nov. 23, 1994

[30] Foreign Application Priority Data

Dec. 1, 1993 [IT] Italy ..... TV93A0106

[51] Int. Cl.[6] ..... A63C 17/14

[52] U.S. Cl. ..... 280/11.2; 188/5

[58] Field of Search ..... 188/5; 280/11.2, 280/11.19, 11.21, 11.22

[56] References Cited

U.S. PATENT DOCUMENTS

| | | | |
|---|---|---|---|
| 341,186 | 5/1886 | Tilden | 280/11.2 |
| 1,402,010 | 1/1922 | Ormiston | 280/11.2 |
| 1,497,224 | 6/1924 | Ormiston | 280/11.2 |
| 1,687,739 | 10/1928 | Slasher | 280/11.2 |
| 2,179,592 | 11/1939 | Goettie | 280/11.2 |
| 4,275,895 | 6/1981 | Edwards | 280/11.2 |
| 5,439,238 | 8/1995 | Neal | 280/11.2 |

FOREIGN PATENT DOCUMENTS

| | | |
|---|---|---|
| 0585764 | 3/1904 | European Pat. Off. . |
| 0599043 | 6/1994 | European Pat. Off. . |

*Primary Examiner*—Richard M. Camby
*Assistant Examiner*—Michael Mar
*Attorney, Agent, or Firm*—Hale and Dorr

[57] ABSTRACT

Braking device, particularly usable for skates which include a shoe composed of a quarter which is articulated to a shell which is in turn associated with a supporting frame for two or more wheels. The device includes at least one elastic strut that allows an axially adjustable link between the quarter and a braking element which is oscillatably articulated to the frame and interacts with the ground in its active position. The device furthermore advantageously includes an element that is suitable to limit forward leg flexing.

13 Claims, 4 Drawing Sheets

BRAKING DEVICE PARTICULARLY FOR SKATES

BACKGROUND OF THE INVENTION

The present invention relates to a braking device particularly usable for skates that include a shoe which is composed of a quarter that is articulated to a shell which is in turn associated with a supporting frame for two or more wheels.

In conventional roller skates, whether constituted by a shoe associated with a support for two pairs of mutually parallel wheels or constituted by a Shoe associated with a supporting frame for one or more aligned wheels, there is the problem of braking said wheels in order to be able to adjust the speed of said skate.

It is thus known to use suitable blocks or pads, usually made of rubber, which are arranged at the toe or heel region of the shoe; when the user tilts the shoe backward or forward, the free end of the blocks or pads interacts with the ground and a braking action is thus achieved.

However, these solutions are not optimum, as they require the user to rotate the shoe, and thus the frame associated therewith, at the toe or at the heel, and this can cause loss of balance with consequent falls.

U.S. Pat. No. 1,402,010 discloses a roller skate that has a band which can be secured on the user's leg above the malleolar region and to which a rod is connected.

Said rod surrounds the leg to the rear and is then curved so as to laterally affect said leg until it is associated at its ends, in the malleolar region, with a lever system that is articulated to a flap that protrudes from the wheel supporting frame.

Said lever system protrudes to the rear of the frame and is connected to a plate which is shaped approximately complementarily to the curvature of part of an underlying facing wheel.

This solution is not free from drawbacks: first of all, it produces relative movement between the band and the leg throughout sports practice, and this does not make it comfortable to use.

The plate is furthermore activated every time the user bends his leg backward beyond a given angle, with no true and easy possibilities of varying this condition.

As each user also has a different leg shape, braking is thus achieved at different rotation angles for an equal rod length.

Said rod furthermore acts and presses in the malleolar region, and this can cause discomfort or accidental impacts. Finally, considerable wheel wear is observed.

U.S. Pat. No. 4,275,895 is known as a partial solution to this drawback, and discloses a brake for skates having two pairs of mutually parallel wheels which acts at the rear wheels.

Said brake is constituted by a flap which is associated with the shoe at the rear; a lamina is associated with said tongue in a rearward position and is pivoted at the supporting frame for the shoe.

Said lamina has, at its free end, a transverse element on which two C-shaped elements are formed at the lateral ends; following a backward rotation imparted to the flap, said C-shaped elements interact with the rolling surface of the rear wheels that face them.

Even this solution, however, has drawbacks: it is in fact structurally complicated and thus difficult to industrialize; it furthermore entails the presence of suitable springs that allow to return the flap to the position in which the two C-shaped elements do not interact with the wheels, and this further increases structural complexity.

Furthermore, the structural configuration of the brake causes the two C-shaped elements to interact with the wheel even upon a minimal backward rotation imparted to the flap, and thus even for involuntary movements; this produces unwanted braking actions and thus possible loss of balance or lack of coordination.

Finally, interaction of the C-shaped element at the rolling surface of the wheels leads to rapid wear of said wheels and thus to non-optimum rolling which necessarily entails continuous wheel replacement.

U.S. Pat. No. 4,300,781 discloses a braking device for skates that comprise pairs of mutually parallel wheels.

Said device thus includes a brake which is constituted by a lamina that is transversely pivoted at the rear end of the supporting frame for a shoe; pads which face the rolling surface of the pair of rear wheels are associated with the ends of said lamina.

The brake is activated by using a cable which is suitable to rotate the lamina, in contrast with a spring associated with the support for the pair of front wheels, so as to move the pads into contact with the rolling surface of the pair of rear wheels.

The cable can be activated by means of rings or handles associated with a band which can be arranged on the lower limbs of the user by virtue of the presence of temporary connection means.

However, this solution has considerable drawbacks: first of all, brake activation can lead to possible loss of coordination during sports practice, as the user must perform an uncoordinated movement.

Furthermore, when traction is applied to the rings the band may disengage from the lower limbs, thwarting the braking action.

In any case there is a loose cable which can accidentally catch during skating, especially because coordination of the arm-legs movement places the legs rhythmically laterally outward.

As a partial solution to these drawbacks, the same Applicant filed on Nov. 30, 1992 patent application no. TV92A000150 which claims the use of a first rod-like element and of a second rod-like element which are respectively connected to a quarter which is articulated to a shell connected to a wheel supporting frame and to a braking element, which is oscillatably articulated to said frame and selectively interacts with the ground when a backward rotation is applied to the quarter; at least one first elastically deformable is interposed between the first rod-like element and the second rod-like element.

Although this solution is undoubtedly valid, it has drawbacks; the use of a first rod-like element and of a second rod-like element in fact entails, due to the intrinsic rigidity of said elements, possible accidental impacts thereof during use of the skate.

It has in fact been observed that in case of accidental impacts, for example in a direction at right angles to the longitudinal axis of the first and second rod-like elements, one or both elements can brake or become deformed, consequently altering or thwarting the braking action.

These impacts can occur, for example, against steps that are provided around skating rinks or to delimit sidewalks.

SUMMARY OF THE INVENTION

The aim of the present invention is therefore to eliminate the drawbacks described above in conventional types by providing a braking device for skates which is structurally very simple, is easy to industrialize, can be activated by the user only when actually needed, and is unaffected by any accidental impacts against rigid bodies, such as for example steps.

An important object is to provide a braking device wherein activation of the braking action can be preset by the user according to his individual specific requirements linked to the shape of the leg and/or to the particular type of sports practice.

Another object is to provide a braking device that protects the rolling surface of the wheels from wear.

Another object is to provide a device which associates with the preceding characteristics that of being reliable and safe in use, has low manufacturing costs, and can also be applied to conventional skates.

This aim, these objects, and others which will become apparent hereinafter are achieved by a braking device, particularly for skates which comprise a shoe composed of a quarter which is articulated to a shell which is associated with a supporting frame for two or more wheels, which is characterized in that it comprises at least one adjustable elastic strut for linking the quarter and a braking element which is oscillatably articulated to the frame and interacts with the ground in its active position.

Advantageously, the structure comprises means which allow to limit forward leg flexing.

BRIEF DESCRIPTION OF THE DRAWINGS

The characteristics and advantages of the invention will become apparent from the following detailed description of a particular embodiment thereof, illustrated only by way of non-limitative example in the accompanying drawings, wherein.

DESCRIPTION OF THE PREFERRED EMBODIMENTS

Figure 1:
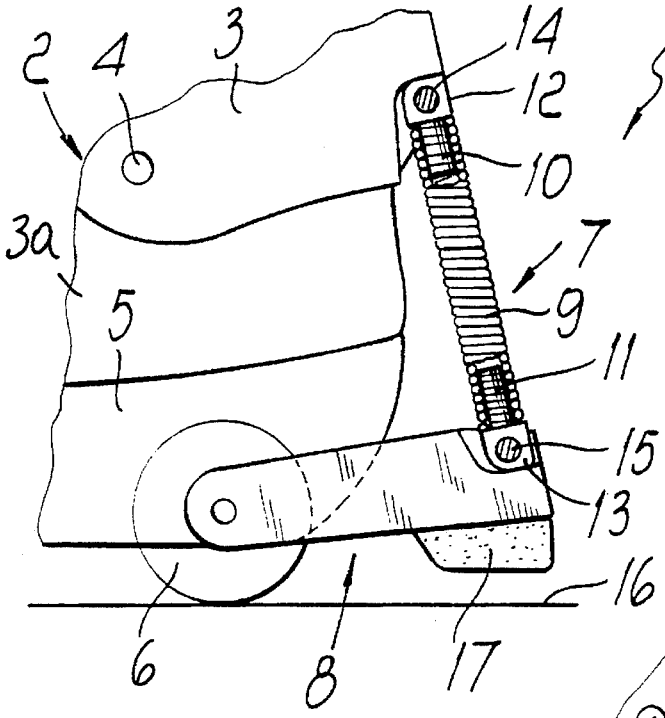
FIG. 1 is a partially sectional side elevation view of the braking device associated with the skate in normal operating conditions.
Figure 2:
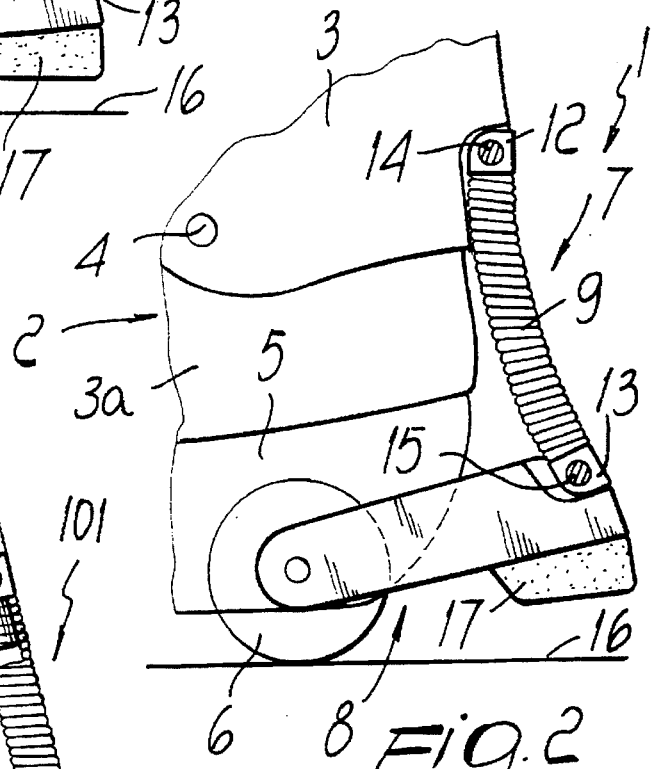
FIG. 2 is a view, similar to FIG. 1, of the device subjected to an impact at the single strut.
Figure 3:
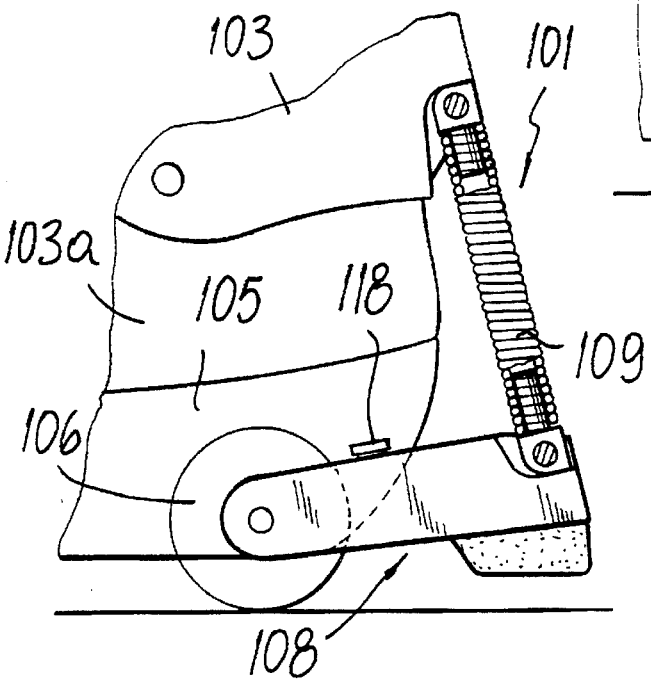
FIG. 3 is a view, similar to FIG. 1, of a different embodiment that includes means allowing to limit the forward flexing of the quarter.

With reference to the above FIGS. 1–3, the reference numeral 1 designates the braking device which is particularly usable for skates, designated by the reference numeral 2.

Said skates comprise a shoe which is composed of a quarter 3 which surrounds at least the rear lateral region of the user's leg and is articulated to a shell 3*a* at suitable holes 4 formed laterally thereon and at seats for suitable studs or rivets or other known rotary connection means.

A supporting frame 5 for two or more wheels, designated by the reference numeral 6 and possibly mutually aligned, is associated below the shell 3*a*.

Suitable known securing levers for the quarter and the shell are applied.

The braking device comprises at least one strut 7 for linking the quarter 3 and a braking element 8 which is oscillatably articulated to said frame 5, preferably at the pivot of one of said wheels 6.

Said strut 7 is elastic, in that it can be subjected to an elastic deformation by a force applied along an axis that does not coincide with the axis passing through the points for connection to the quarter and to the braking element, but is substantially rigid if subjected to a load applied at its ends and thus along an axis that passes through said points for connection between the quarter and the braking element.

Accordingly, said strut 7 advantageously comprises an elastic element, such as a spring 9, whose turns are compacted so as to allow its use as a strut that meets the above given requirements.

A first stem 10 and a second stem 11 are rotatably associated respectively at the ends of the spring 9 and are preferably oppositely threaded; said stems protrude respectively from a first head 12 and from a second head 13 which is pivoted transversely, by means of a first pivot 14 and a second pivot 15, to adapted tabs that protrude to the rear of the quarter 3 or above the braking element 8 or are formed thereat.

Said first and second stems furthermore constitute means for adjusting the center distance between the first pivot 14 and the second pivot 15 and for accordingly adjusting the space between the ground 16 and a pad 17 which interacts with it and is associated below the braking element 8.

As also shown in FIG. 2, the use of a strut, which however also has elastic characteristics and is thus for example constituted by a spring, allows on one hand to transmit the backward rotation of the quarter directly to the braking element 8 and thus achieve braking, and on the other hand to absorb any impacts along axes that do not coincide with the axis of said spring while preserving functionality for braking.

It has thus been observed that the invention has achieved the intended aim and objects, a skate with aligned wheels having been obtained in which it is possible to brake only when actually necessary without at the same time being affected by any accidental impacts against rigid bodies, such as for example steps, by virtue of its possibility to deform elastically.

The structure is naturally susceptible to numerous modifications and variations, all of which are within the scope of the same inventive concept.

Thus, for example, FIG. 3 illustrates a different embodiment for a device 101 that comprises a shell 103*a* with which a supporting frame 105 for two or more wheels 106 is associated; a braking element 108 is associated with said shell and interacts with means that allow to limit the forward flexing of the leg; said means are constituted by at least one abutment element 118 which is laterally associated with the frame 105; said abutment element 118, once the braking element 108 abuts against it, subjects the spring 109 to traction, and said spring elastically contrasts the forward rotation of the quarter 103.

Figure 4:
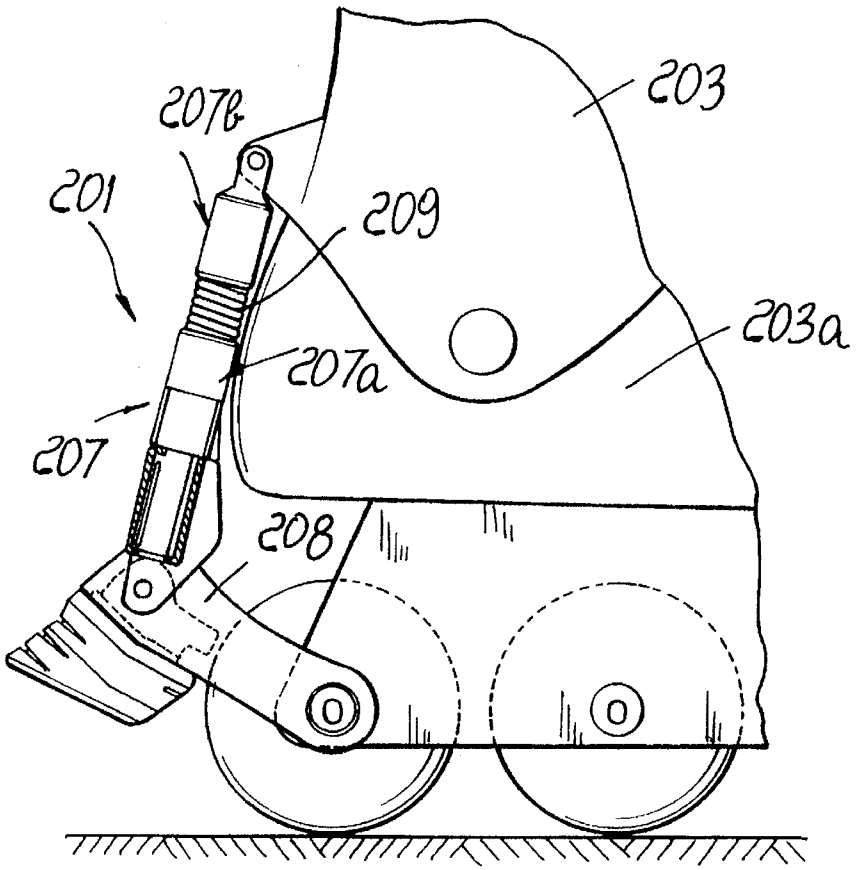
FIG. 4 is a partial section side elevation view of the braking device according to a further embodiment of the strut.

With reference to FIG. 4, a different embodiment of the braking device 201 is shown, applied to a skate comprising a shell 203*a* having a quarter 203 articulated thereto, in which the strut 207 has a lower portion 207*a* articulated to the braking element arm 208 and an upper portion 207*b* which is pivoted to the quarter 203. The two portions 207*a* and 207*b* are interconnected by a spring element 209 with a close-packed spiral formation.

The useful length of the lower portion 207*a* is advantageously adjustable, as will become clear hereinafter.

Figure 5:
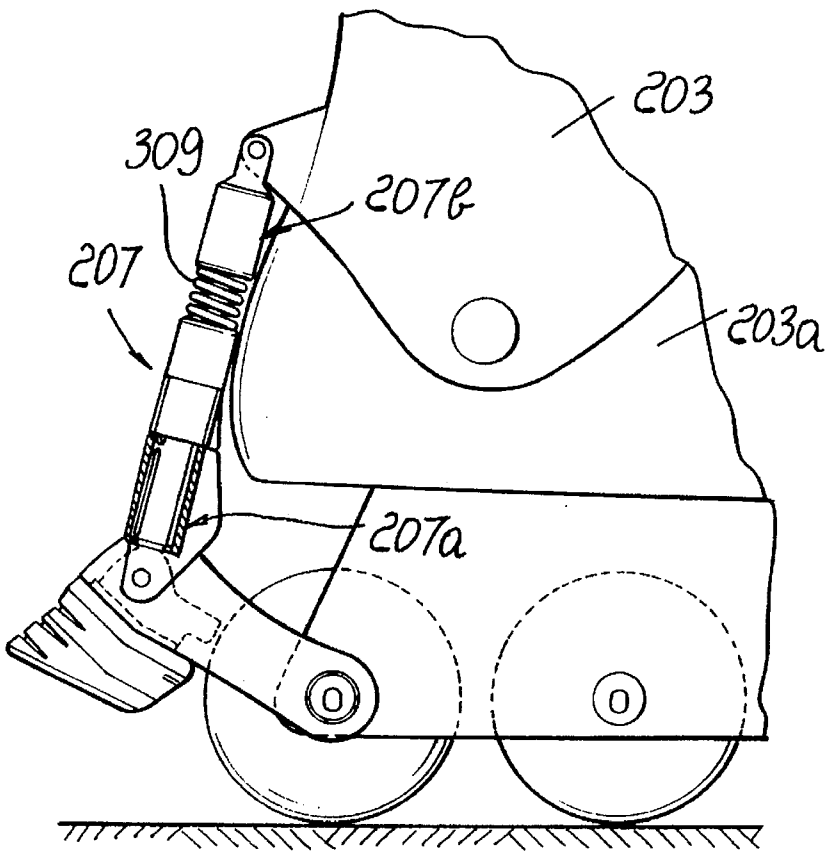
FIG. 5 is a partial section side elevation view of the braking device with a strut provided with a spring.

FIG. 5 shows a further embodiment of the invention in which the strut, again referenced by the reference numeral 207, is structurally analogous to the strut of FIG. 4, while the spring 309 has a distanced-packed spiral formation, in non-braking or rest position of the braking device, thereby to provide, in addition to the absorption of lateral shocks as in the previously described embodiment, the possibility to obtain a progressive braking action, since the contact between the braking pad and the ground is gradual and damped by the spring.

Furthermore, the vibrations which occur during the braking stage, when the pad is in contact with the ground, are no longer transmitted to the quarter and to the user's leg, since they are deadened by the spring, thereby to achieve less tiring out of the skater.

Figure 6:
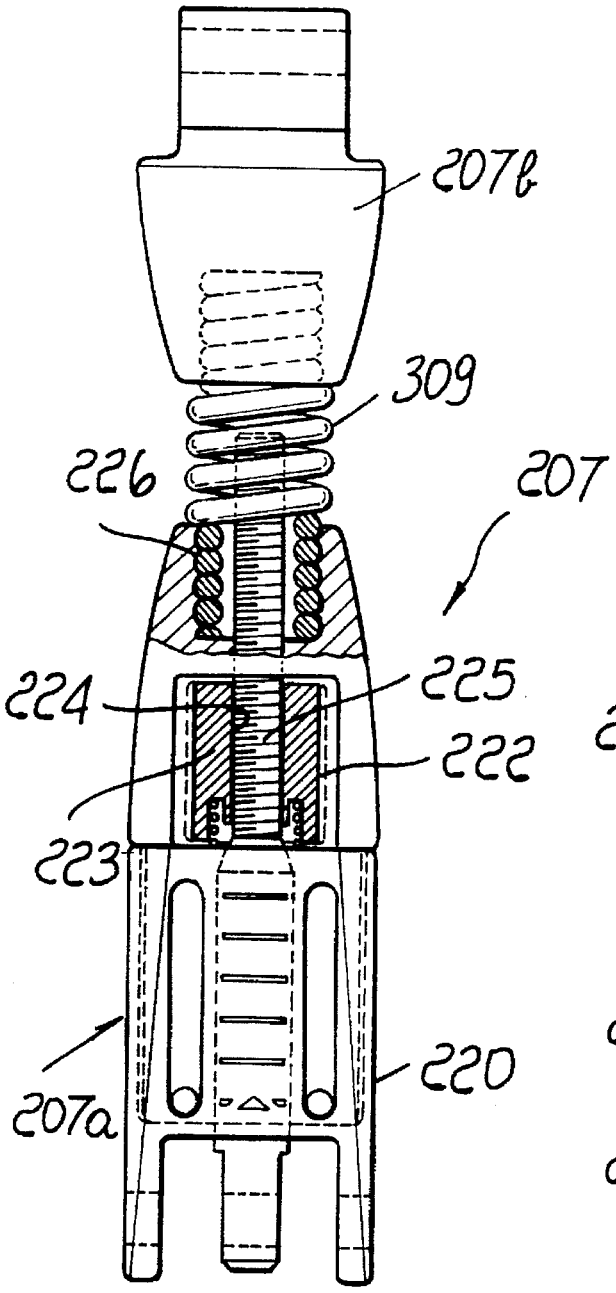
FIG. 6 is a partial section front elevation view of the strut shown in FIG. 5.
Figure 7:
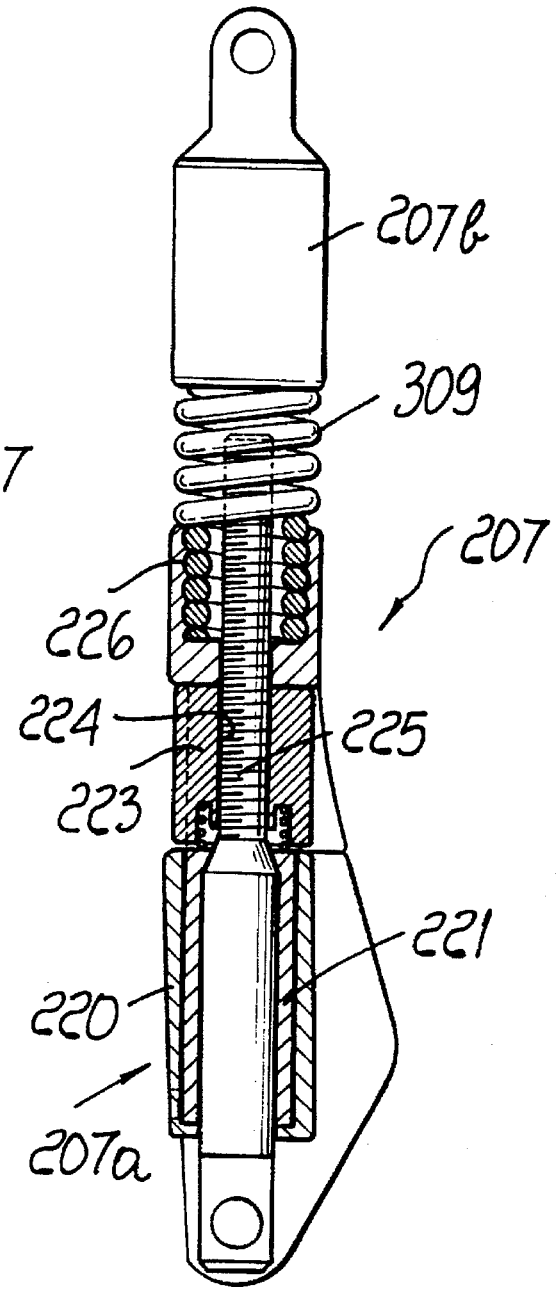
FIG. 7 is a partial section side elevation view of the strut of FIG. 6.

The strut 207, as best seen in FIGS. 6 and 7, comprises the lower part 207*a* which is made of an external portion 220 pivoted to the braking element arm and which internally accommodates a slider 221. The slider 221 comprises, externally to the portion 220, an opening 222 in which an adjustment knob 223 with an internal threading 224 is rotatably accommodated. The knob 223 is screwed onto a threaded stem 225 which is fixed to the external portion 220.

The rotation of the knob 223 thereby provides a translatory movement of the slider 221, which is prevented from rotating, and consequently the useful length of the strut is varied.

At the free end of the slider 221, a seat 226 is defined in which a first end of the spring is inserted. The spring can be constituted by the spring 209 with close-pack spiral structure or by the spring 309 with the mutually distanced spirals.

The other end of the spring 209 or 309 is inserted in the upper portion 207*b* of the strut which in turn is articulated to the quarter.

Figure 8:
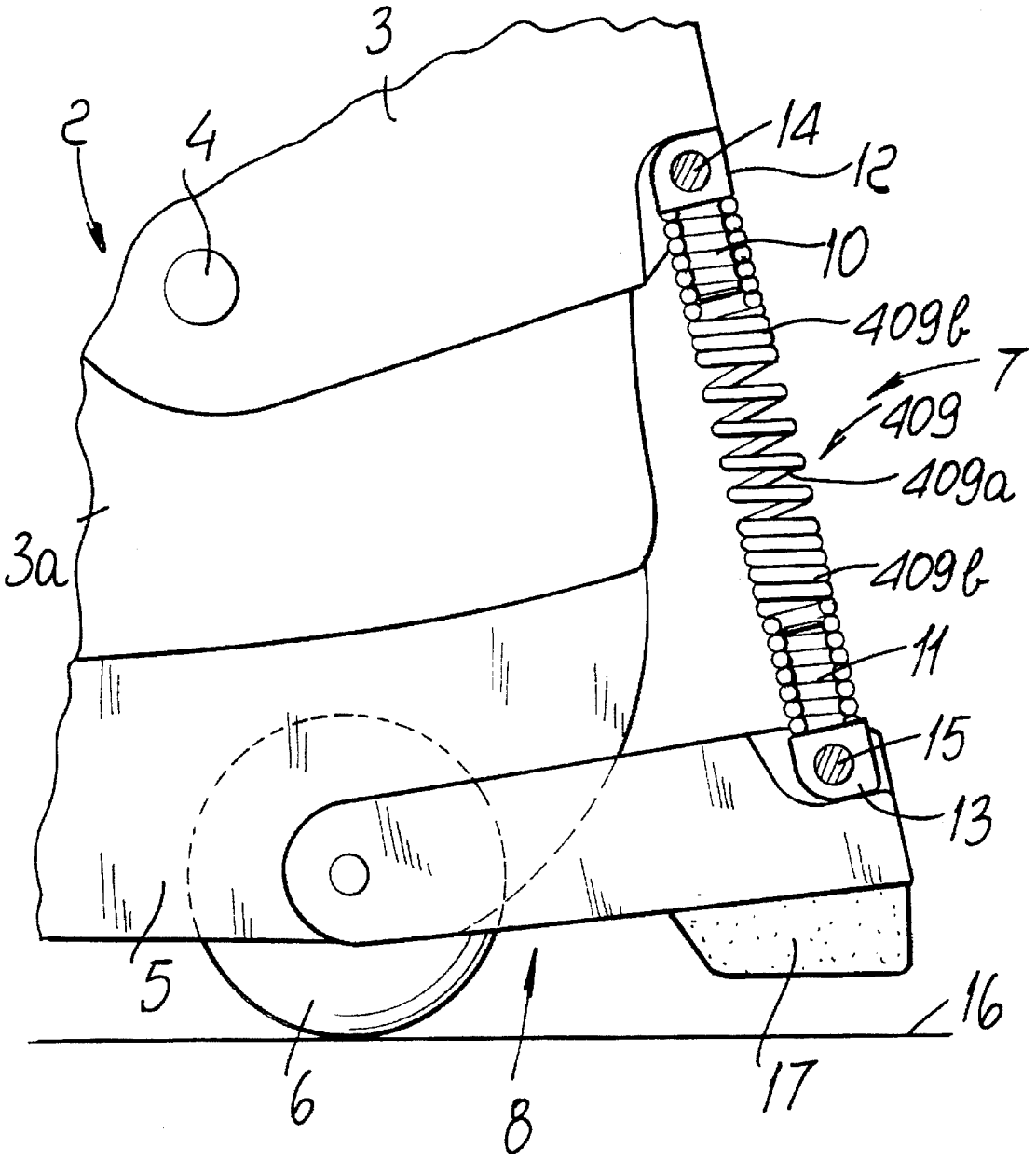
FIG. 8 shows a further embodiment of the invention similar to that of FIG. 1 with an elastic suspension provided on the strut.

With reference to FIG. 8, an embodiment conceptually analogous to that of FIG. 1 is shown, in which the only difference resides in that a spring 409 is provided, in the median portion thereof, with spirals 409*a* which are mutually distanced thereby to provide an elastic suspension.

In practice, the spring 409 is provided at its end attachment zones spirals 409*b* which are close-packed, while the median portion is provided with mutually distanced spirals. The technical features in FIG. 8 which correspond to the same technical features as shown in FIG. 1 have been referenced by the same reference numerals.

The materials and the dimensions that constitute the individual components of the structure may naturally be the most pertinent according to the specific requirements.

What is claimed is:

1. A braking device, particularly for skates which comprise a shoe composed of a quarter which is articulated to a shell which is associated with a supporting frame for two or more wheels, said device comprising:

a braking element which is oscillatably pivoted relative to said frame for movement generally upwardly and downwardly relative to said frame, said braking element having a ground engaging pad interacting with the ground in a downward position; and at least one strut linking said quarter and said braking element such that articulation of said quarter rearwardly relative to said frame causes said strut to move said braking element downwardly and articulation of said quarter forwardly relative to said frame permits upward movement of said braking element, said strut including an elastic element extending along a longitudinal axis of said strut and arranged to transmit compressive force along said longitudinal axis to move said braking element downwardly when said quarter is articulated rearwardly, said elastic element being capable of lateral deformation when a force is applied to said elastic element along an axis that is disposed at an angle relative to said longitudinal axis.

2. Braking device according to claim 1, wherein opposite ends of the strut are connected respectively to said quarter and to said braking element, and said at least one strut is substantially rigid if subjected to compressive stress at its ends and thus along an axis that passes through said points for mutually connecting said quarter and said braking element.

3. Braking element according to claim 1, wherein said at least one strut comprises an elastically deformable element having turns that are compacted so that said element cannot be compressed by a force applied to it along an axis that coincides with the axis that passes through the points at which said strut is linked to said quarter and to said braking element and is elastically deformable if subjected to a force applied to it along an axis disposed at an angle to said axis that passes through said points.

4. Braking device according to claim 3, wherein a first stem and a second stem are rotatably associated with the ends of said element, said first and second stems protruding respectively from a first head and a second head which are transversely pivoted by means of a respective first pivot and a second pivot to respective tabs.

5. Braking device according to claim 4, wherein said first and second stems constitute means for adjusting a distance between said first pivot and said second pivot and thus for adjusting the space between the ground and said pad.

6. Braking device according to claim 3, wherein said spring has compacted spirals in correspondence with the end portions thereof and mutually distanced spirals at the median portion thereof.

7. Braking device according to claim 1, further comprising means suitable to limit the forward rotation of the quarter.

8. Braking device according to claim 7, wherein said means suitable to limit the forward rotation of the quarter are constituted by at least one abutment element which interacts with said braking element beyond a given degree of forward rotation of the quarter.

9. Braking device according to claim 1, wherein said at least one strut comprises a lower portion which is articulated to said braking element and an upper portion which is articulated to said quarter, said lower portion and said upper portion being mutually interconnected by means of a spring having a spiral structure.

10. Braking device according to claim 9, wherein said lower portion of said strut has an adjustable useful length.

11. Braking device according to claim 9, wherein said spiral structure is close-packed.

12. Braking device according to claim 1, wherein said strut comprises a lower portion which is articulated to said braking element and an upper portion which is articulated to said quarter, said lower portion being interconnected with said upper portion by means of a spring having spirals which are mutually distanced.

13. A braking device, particularly for skates, which comprise a shoe composed of a quarter which is articulated to a shell which is associated with a supporting frame for two or more wheels, wherein said device comprises at least one adjustable elastic strut for linking said quarter and a braking element which is oscillatably articulated to said frame and interacts with the ground in an active position, said at least one strut comprises a lower portion which is articulated to said braking element and an upper portion which is articulated to said quarter, said lower and said upper portions being mutually interconnected by means of a spring having a spiral structure, said lower portion of said strut having an adjustable useful length, and said lower portion comprises an external portion which is pivoted to said braking element and a slider which is slidably accommodated inside said external portion, said slider defining, externally to said external portion, an opening in which an adjustment knob is rotatably accommodated, said knob having a threaded seat engaged with a threaded stem which is fixed to said external portion.

* * * * *